United States Patent [19]

Yavnieli et al.

[11] 4,151,577

[45] Apr. 24, 1979

[54] IONIZATION DEVICE EMPLOYING A GROUNDED INSULATIVE HOUSING MEMBER SPACED FROM AN IONIZATION ELECTRODE

[75] Inventors: Mordechai Yavnieli, Tel Aviv; Meir Zeldov, Herzlia, both of Israel

[73] Assignee: Amcor Ltd., Tel Aviv, Israel

[21] Appl. No.: 753,445

[22] Filed: Dec. 22, 1976

[30] Foreign Application Priority Data

Jan. 9, 1976 [IL] Israel ..... 48817
Mar. 16, 1976 [IL] Israel ..... 49220

[51] Int. Cl.[2] ..... H05F 3/02
[52] U.S. Cl. ..... 361/231
[58] Field of Search ..... 361/220, 230, 231, 229, 361/235, 29

[56] References Cited

U.S. PATENT DOCUMENTS

| | | | |
|---|---|---|---|
| 2,264,495 | 12/1941 | Wilner | 361/231 |
| 3,369,152 | 2/1968 | Spengler | 361/230 |
| 3,624,448 | 11/1971 | Saurenman et al. | 361/231 |
| 3,742,237 | 6/1973 | Parker | 361/230 |
| 3,742,301 | 6/1973 | Burris | 361/230 |
| 3,936,698 | 2/1976 | Meyer | 361/231 |
| 3,976,880 | 8/1976 | Brunelle et al. | 361/229 |

FOREIGN PATENT DOCUMENTS

| | | | |
|---|---|---|---|
| 1319296 | 1/1963 | France | 361/231 |

*Primary Examiner*—Gerald Goldberg
*Attorney, Agent, or Firm*—Browdy and Neimark

[57] ABSTRACT

An ionization device comprising an ionization electrode coupled to a source of high voltage; an insulative housing member disposed in spaced adjacent relationship to the ionization electrode; and a conductor coupled to ground and to the insulative housing member; the insulative housing member and the conductor being arranged for providing a controlled flow of electric charges from the insulative member to ground.

7 Claims, 5 Drawing Figures

IONIZATION DEVICE EMPLOYING A GROUNDED INSULATIVE HOUSING MEMBER SPACED FROM AN IONIZATION ELECTRODE

FIELD OF THE INVENTION

The present invention relates to devices producing ionization of air particles.

BACKGROUND OF THE INVENTION

Ionization devices are well known for use in enhancing environments in which human activities take place, for example, in reducing the uncomfortable effects of a highly pollenated atmosphere or an atmosphere which contains too few negative ions and a surplus of positive ions. Breathing in an excess proportion of positive ions tends to lower the oxygen level of the blood and increases the accumulation of serotonin (HT-5) a neurohormone that induces sleepiness, depression, irritability, respiratory ailments and headaches. Inhalation of negative ions increases the body's ability to absorb and utilize oxygen and reduces the level of serotonin, thus eliminating all the ill-effects of the positive ions. Such inhalation is known to produce an uplifting effect as well as to increase a person's general sense of wellbeing.

Conventional ionization devices, hereinafter termed ionization devices of the kind specified, comprise an ionization electrode, and means for coupling the electrode to a source of high voltage. The ionization electrode is typically in the form of a conductive needle or a very fine wire. To produce negative ions, air particles in the vicinity of a negative ionization electrode are ionized by electrons provided by the electrode.

Conventionally, shields are provided in coaxial peripheral spaced disposition with respect to the ionization electrode for preventing accidental direct contact with the needle which could result in significant injury due to the high voltage involved. Spurious contact between the high voltage electrode and various objects such as clothing or furniture can also cause damage to the needle.

One conventional type of ionization device employs a generally tubular shield arranged coaxially about the ionization electrode and formed of insulative material. The presence of such a shield results in the following drawback: Ions of the same sign as those being produced at the electrode tend to build up along the surfaces of the shield. The build-up of these ions can result in the establishment of an electrostatic field which inhibits the creation of such ions at the electrode and thus gradually reduces the ion-producing efficiency of the electrode.

There is also produced a further repulsive electric field generated by the ion cloud present in the immediate vicinity of the electrode and identically charged to the ions being produced thereby. This additionally impedes ion production.

A second type of conventional ionization device employs a tubular shield formed of conductive material connected to ground, and disposed in coaxial spaced relationship with respect to the ionization electrode. The use of a conductive shield involves the risk of electrical arcing from the ionization electrode to the grounded shield in the event of momentary shortening of the electrical path between the shield and the electrode due to the presence of spurious material therebetween.

A further difficulty in the use of conductive grounded shields is that ions produced by the ionization electrode tend to migrate to the grounded shield instead of becoming dispersed in the atmosphere as desired.

U.S. Pat. No. 3,234,432 shows an air ionizer comprising a sheet metal shield electrode and a fine wire electrode. The shield electrode is coupled to ground across a resistance in the megaohm range and provides a path of controlled leakage of ions during normal operation thus providing a relatively proportional flow of ions to the shield electrode and an easily controlled flow of ions for application to a subject. U.S. Pat. Nos. 3,783,283 and 3,396,308 both relate to the use of ionization in electro-photography. The former patent shows a grounded semi-conductor shield for use in association with an ionization electrode. The latter patent shows a conductive housing having dielectric strips between the housing and the ionization electrode which are coupled to ground across a very high resistance. According to an alternative embodiment shown in the latter patent the housing is made of a dielectric material and conductive strips are interposed between the housing and the ionization electrode.

The present invention seeks to overcome the disadvangages of prior art ionization devices and provides a device constructed to have a housing or shield in the vicinity of the ionization electrode and having an ion distribution efficiency at least as great as that of a device in which no housing or shield is disposed in the vicinity of the ionization electrode.

A further significant limitation in conventional ionization devices is that the range of effectiveness of such devices is limited to approximately 3 to 4 meters from the ionization electrode. It is often desired to distribute negative ions in a relatively large open or closed volume such as in a factory, airplane or meeting hall. In order to achieve these objectives with conventional ionization devices, it is necessary to provide a number of such devices and to distribute them over the volume, the distribution arrangement being dictated by the effective range of each device. This involves a relatively high cost due to the fact that each conventional device is provided with its own separate power supply and thus relatively bulky units are required and significant cost is involved.

SUMMARY OF THE INVENTION

In accordance with the present invention, there is provided an ionization device comprising an ionization electrode exposed to the atmosphere and coupled to a source of high voltage; an insulative housing member disposed in spaced, non-touching, adjacent relationship to said ionization electrode; and a conductor coupled to ground and to the insulative housing member; the insulative housing member and the conductor being arranged for providing a controlled flow of electric charges from said insulative member to ground.

Further in accordance with an embodiment of the invention the insulative housing and associated conductor are disposed in a generally surrounding arrangement about said ionization electrode.

Also in accordance with an embodiment of the invention the conductor may conveniently comprise an insulated wire.

It is a purpose of the present invention to provide means which reduce the electrostatic field in the vicinity of the housing by providing a relatively controlled flow of charges from the housing to ground. Additionally, in accordance with the invention, the buildup of an electrostatic field in the ion cloud surrounding the ionization electrode is prevented by the controlled discharge of ions at the housing.

There is also provided in accordance with an embodiment of the present invention a modular ionization device comprising a plurality of ionization devices as described above, each disposed in a location remote from the other and means for coupling said devices to a central power supply.

Further, in accordance with the invention, a plurality of ionization devices as described above can be selectively coupled to a single central power supply.

In accordance with an embodiment of the invention each of the ionization devices comprises a plurality of ionization electrodes.

Further in accordance with an embodiment of the invention, means are also provided for selectively energizing the individual ionization devices from a central location.

BRIEF DESCRIPTION OF THE DRAWINGS

The invention will be more fully understood and appreciated from the following detailed description taken in conjunction with the drawings in which.

DETAILED DESCRIPTION OF THE INVENTION

Figure 1:
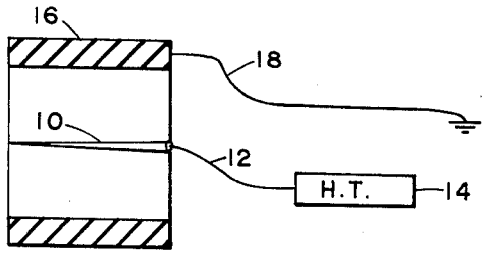
FIG. 1 is a schematic diagram of an embodiment of an ionization device constructed and operative in accordance with an embodiment of the invention.

Referring now to FIG. 1 there is shown in schematic form a device for producing negative ions including an ionization electrode 10 in the form of a needle coupled by means of an electrical conductor 12 to a source of high voltage 14, typically providing voltage of −5000 volts DC. A generally cylindrical tubular shield 16 is disposed in spaced generally coaxial relationship with respect to ionization needle 10 and is connected via a conductor 18 to ground. Shield 16 is formed of an insulator such as a plastics material.

According to alternative embodiments of the invention, ionization needle 10 may be replaced by any other suitable type of ionization electrode and shield 16 may be formed of any suitable insulative material or alternatively shield 16 may be formed of an insulator combined with an outer conductive coating.

Figure 2:
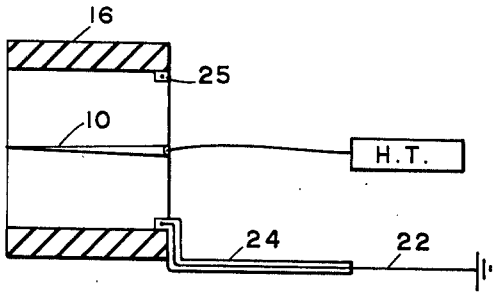
FIG. 2 is a schematic diagram of an alternative embodiment of an ionization device constructed and operative in accordance with an embodiment of the invention.

Referring now to FIG. 2 there is shown an alternative type of connection between shield 16 and ground. According to the embodiment of the invention shown in FIG. 2, conductor 22, connected to ground, is covered with an insulative material 24 such as PVC. The insulated conductor may conveniently comprise a conventional insulated wire 25 arranged in a generally surrounding looped arrangement along the inner surface of shield 16, as illustrated in FIG. 2.

It is appreciated that the location of the conductor with respect to ionization electrode 10 and shield 16 is selected such that the conductor provides a controlled leakage of electrostatic charges from the insulative shield to ground without causing an appreciable electric field concentration between the ionization electrode and the conductor which could severly reduce the desired efficiency of ion distribution in the atmosphere.

Figure 3:
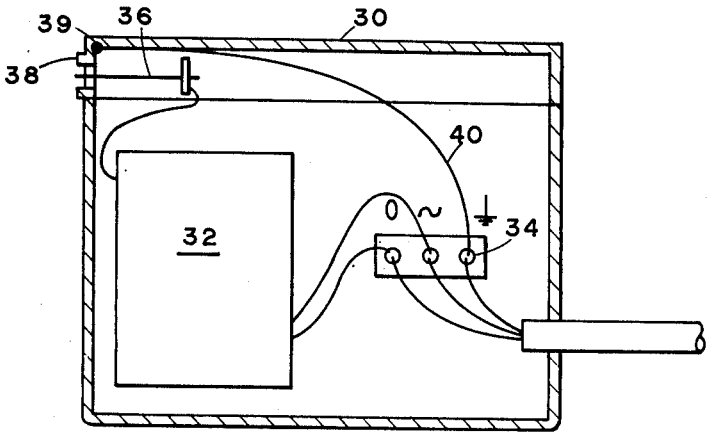
FIG. 3 is a sectional illustration of an ionization device constructed and operative in accordance with an embodiment of the invention.

Referring now to FIG. 3 there is shown in a sectional view an ionizing device comprising an insulative housing 30, a high voltage power supply 32, connection terminals 34 coupled respectively to ground and to a supply voltage and an ionization electrode 36 in the form of a needle. A shield 38 formed of an insulating material surrounds the outermost tip portion of electrode 36. An electrical connection between the shield and ground is provided via a conductor 40 which extends to a location 39 adjacent the shield such that a controlled charge leakage path is defined between shield 38 and ground. The ionization device shown in section in FIG. 3 may be constructed to have one or more ionization electrodes arranged in spaced relationship, each surrounded by a shield and each connected to a common power supply.

Figures 4, 5:
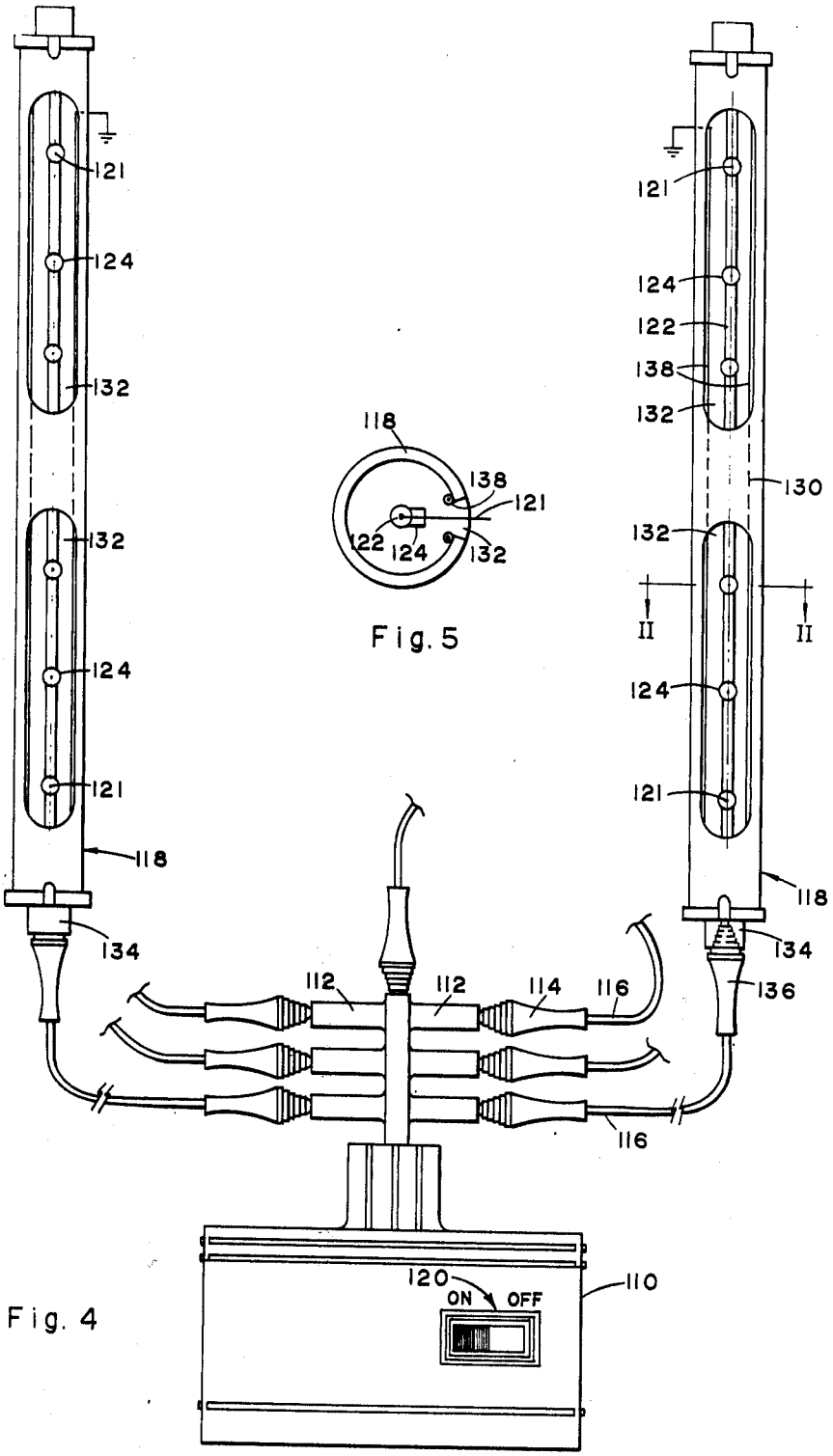
FIG. 4 is a partial pictorial illustration of a central power supply associated with a plurality of ionization electrode assemblies.
FIG. 5 is a sectional view of an ionization electrode assembly taken along the lines II—II of FIG. 4.

Referring now to FIGS. 4 and 5 there is shown a modular ionization device comprising a power supply 110, and a plurality of electrode assemblies 118.

In accordance with a preferred embodiment of the invention illustrated herein, there are provided connecting elements 112 which comprise female sockets for selectable mating engagement with male connectors 114 which are in turn coupled to conductors 116 for supplying current at relatively high voltage to ionization electrode assemblies 118.

In the exemplary embodiment illustrated in FIG. 4, seven connecting elements are provided. It is appreciated and should be understood that any number of connectors greater or less than seven may be provided in accordance with the invention and the number of connectors is limited only by the capacity and design of power supply 110.

Power supply 110 is provided with an On-Off switch 120 which governs the operation of the power supply as a whole. According to an alternative embodiment of the invention a plurality of On-Off switches may be provided for independently controlling operation of one or more of the electrode assemblies. Alternatively, this function may be provided by selectable insertion of male plugs 114 into sockets 112.

According to a preferred embodiment of the invention each ionization electrode assembly 118 comprises a plurality of ionization electrodes 121 disposed in relatively spaced relationship on a conductive mounting support 122 by means of mounting members 124.

Mounting support 122 is disposed relatively coaxially with an outer housing 130 formed of plastic or any suitable insulative material and having exposure windows 132 formed thereon to permit exposure of the ionization electrodes to the outside atmosphere.

In accordance with a preferred embodiment of the invention, housing 130 is configured in generally surrounding relationship to the ionization electrodes. A conductor 138 is disposed along the inside walls of said housing in spaced adjacent relationship to the ionization electrodes and is connected to ground by means (not shown) thereby to define the desired controlled charge leakage path. Conductor 138 may typically comprise one or more sections of insulated wire arranged in a looped or straight arrangement. The use of insulated wire enables the conductor to be placed closer to the electrode than would be possible if insulation were not provided.

At one or both extreme ends of mounting support member 122 there is provided a female socket 134 which is configured for mating relationship with a male connector 136 coupled to the opposite end of respective conductor 116.

Electrode assemblies 118 may be mounted in any convenient location by suitable mounting means such as brackets (not shown) attached to housing 130 at the extreme ends thereof.

It will be clear to those skilled in the art that the invention is not limited to what has been specifically shown and described hereinabove in conjunction with an exemplary embodiment of the invention. Rather the scope of the invention is defined only by the claims which follow:

We claim:

1. An ionization device comprising:

an ionization electrode exposed to the atmosphere;

a source of high DC voltage;

means for coupling said ionization electrode to said source of high DC voltage;

an insulative housing member disposed in spaced non-touching adjacent relationship to said ionization electrode;

a wire coupled to ground; and an insulative peripheral coating completely surrounding said wire;

said thus coated wire being disposed between said insulative housing member and said electrode in an uninterrupted line of sight with respect to said ionization electrode and providing a controlled flow of electric charges from said insulative member to ground.

2. An ionization device according to claim 1, wherein said insulative housing member and said associated coated wire are disposed in a generally surrounding arrangement about said ionization electrode.

3. An ionization device according to claim 1, wherein said insulative housing member comprises a generally cylindrical tubular shield member disposed substantially equidistant to the periphery of said ionization electrode.

4. Ionization apparatus according to claim 1 and comprising a plurality of said ionization electrodes;

a plurality of said insulative housing members disposed at discrete locations remote from one another; and a plurality of said coated wires;

and wherein said means for coupling comprises means for selectively coupling said source of high DC voltage to said plurality of ionization electrodes.

5. Ionization apparatus according to claim 1 and comprising a plurality of said ionization electrodes;

and wherein:

said means for coupling comprises means for coupling said source of high DC voltage to said plurality of ionization electrodes; and said coated wire passes alongside and in directly exposed relationship to said plurality of said ionization electrodes.

6. Ionization apparatus according to claim 4 and wherein a plurality of ionization electrodes are associated with each insulative housing member.

7. Ionization apparatus according to claim 4 and also comprising means for selectively energizing said plurality of ionization electrodes from a central location.

* * * * *